US005765651A

United States Patent [19]

Sweeney

[11] Patent Number: 5,765,651

[45] Date of Patent: Jun. 16, 1998

[54] CABLE-TOOL CASING HAMMER

[76] Inventor: Gerald T. Sweeney, 37222 28th Ave. South, Federal Way, King County, Wash. 98003

[21] Appl. No.: 833,933

[22] Filed: Apr. 10, 1997

[51] Int. Cl.[6] ..... E21B 7/20

[52] U.S. Cl. ..... 173/53; 173/92; 173/149

[58] Field of Search ..... 173/53, 54, 55, 173/92, 149, 91

[56] References Cited

U.S. PATENT DOCUMENTS 3,166,351 1/1965 Baudrillard ..... 173/54
3,722,603 3/1973 Brown ..... 173/149
4,516,662 5/1985 Kostylev et al. ..... 173/53
4,676,312 6/1987 Mosing et al. ..... 173/149
4,759,412 7/1988 Brazell, II ..... 173/92

*Primary Examiner*—Scott A. Smith
*Attorney, Agent, or Firm*—James F. Leggett

[57] ABSTRACT

A novel improvement in a tubular ram device for bi-directional driving of pipe casing, vertically or horizontally, wherein the driving hammer imparts the force to the pipe casing through a bowls-anvil and removable collet, thus allowing driving of sections of pipe casing without removing the tubular ram device or making any physical change to the pipe casing.

4 Claims, 2 Drawing Sheets

CABLE-TOOL CASING HAMMER

BACKGROUND OF THE INVENTION

This invention relates generally to a means of driving hollow pipe casing with a reciprocating piston-powered ram, such as disclosed in U.S. Pat. No. 4,544,040, wherein the force of the blow of the drive weight is imparted to one end of a standard bowls, also known as an anvil, which transmits said force through the divergent face of the tapered body of the bowls to the divergent face of the tapered body of a collet, also known as a slips, which squeezes the inner face of the collet against the external face of the hollow pipe casing, thus imparting the force of the drive weight to the hollow pipe casing so as to drive it into the ground without requiring special adaptation of the casing, all so that raising the bowls from the collet releases the hollow pipe casing so that continuous sections of hollow pipe casing can be driven without removing the bi-directional pipe drilling ram from the hollow pipe casing.

It has been known that hollow pipe casing can be driven into the ground by means of a bi-directional pipe driving ram, such as disclosed in U.S. Pat. No. 3,474,870 and powered as disclosed in U.S. Pat. No. 4,544,040. These drive systems require the hollow pipe casing, being driven, to be equipped with a reinforced drive head to protect the pipe casing from damage. This drive head had to be removed from the section of pipe casing when it reached sufficient depth so that a new section of pipe casing was mated to it, then the drive head was installed on the end of the new section of pipe casing. This procedure was time consuming and costly. Likewise, systems such as disclosed in U.S. Pat. No. 3,474,870 were limited to pipe casing having a reinforced collar against which to impart the force of the ram, while rod-clamping devices, such as disclosed in U. S. Pat. No. 4,516,662, impart the drive force to localized jamming elements which would damage standard hollow pipe casing. In addition, types of bowls and collets similar to those described in this specification have been known and used in the drilling industry to lift or position pipe casing because of their ease of grabbing and releasing the pipe casing, but have never been considered or utilized in the new and novel manner as described and claimed herein.

The primary object of this invention is to provide a means of continuously driving sections of hollow pipe casing which does not require any special modification to the hollow pipe casing and can be utilized with existing bi-directional pipe driving rams available in the drilling profession. Another object of this invention is to accomplish the primary object with minimum expense and allow its adaptability to the gauges of pipe casing regularly utilized in the drilling industry. A further object of this invention is to accomplish the foregoing objectives in vertical or horizontal drilling situations without damage to the hollow pipe casing and to enable the driving force of the bi-directional pipe driving ram to be applied in either direction on the hollow pipe casing without the need to remove the bi-directional driving ram from the hollow pipe casing.

SUMMARY OF INVENTION

These objects are achieved by this invention in that it utilizes a standard bowls and collet assembly to receive the force of the ram and transfer said force to the exterior face of the pipe casing. Each gauge of pipe casing is capable of bearing a predetermined drive force against its external face without incurring damage and the ram impact force is adjusted to impart that degree of force.

The novel features of the invention will be best understood from the following description in light of the accompanying drawings. While particular embodiments of the present invention are shown and described, it will be obvious to those skilled in the art that changes and modifications may be made without departing from this invention in its broader aspects and, therefore, the aim of the appended claims is to cover all such changes and modifications as fall within the true spirit and scope of this invention.

DESCRIPTION OF THE PREFERRED EMBODIMENTS

Figure 1:
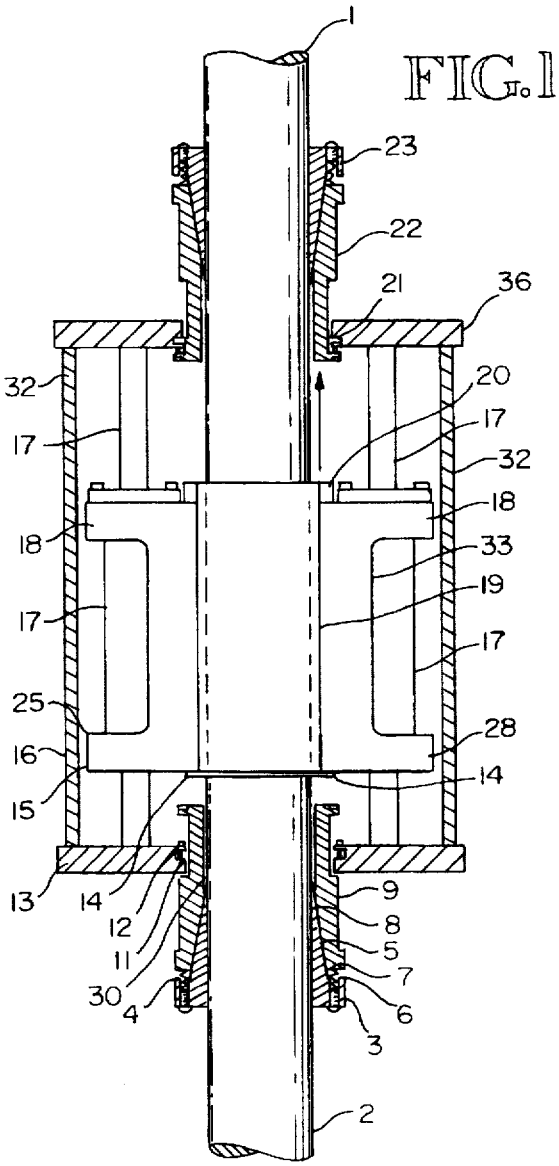
FIG. 1 is a front elevation of my invention.
Figure 5:
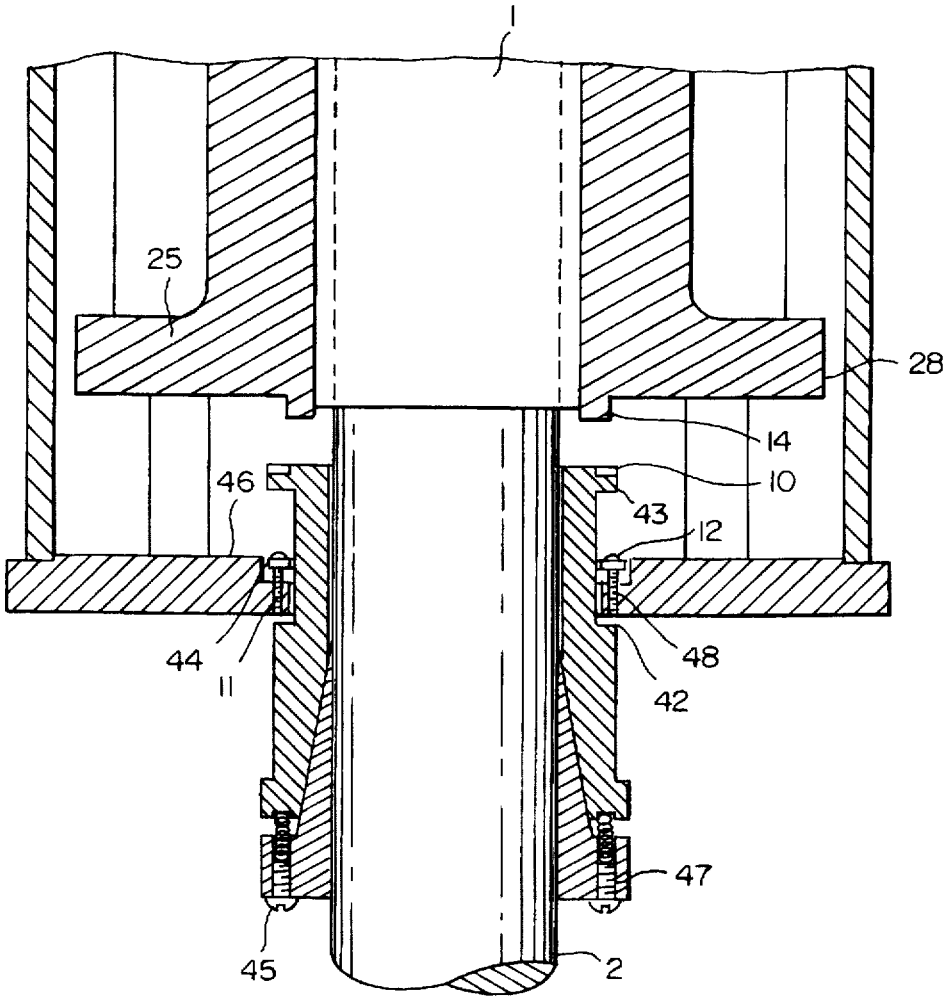
FIG. 5 is a front elevation of my invention.

With reference to the drawings and particularly FIGS. 1 and 5, the preferred embodiments of the Cable-Tool Casing Hammer are shown. The Cable-Tool Casing Hammer is a bi-directional pipe driving apparatus, having a cylindrical channel (19) throughout its length, to include the drive weight (25), of sufficient diameter to slidably accommodate a hollow pipe casing (1) to be driven, comprised of a bi-directional pipe driving ram (15), powered by suitable means, such as steam or water pressure, bowls (9), (22) and collets or slips (3), (23) located upon a hollow pipe casing (1) at either end of the bi-directional pipe driving ram (15).

Figure 2:
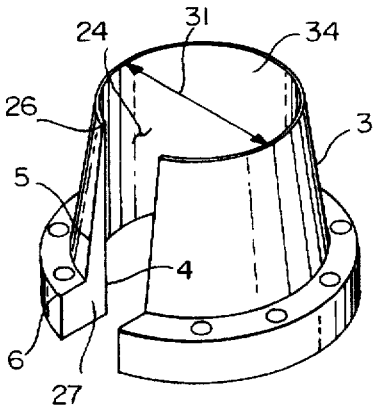
FIG. 2 is an elevational view of a collet.
Figure 3:
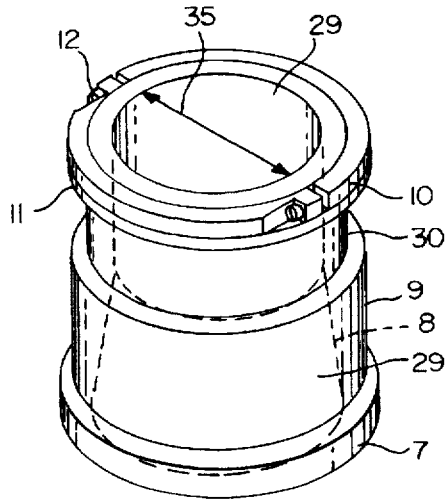
FIG. 3 is an elevational view of a bowls.

Referring to FIGS. 2 and 3, this invention is comprised of a collet, or slips, (3) comprised of a circular piece of hardened metal material, with a cylindrical interior (34) and an opening (24) along its length of sufficient width to slidably accommodate a hollow pipe casing (1) within its internal diameter (31) when open and firmly grasping the external face (2) of the hollow pipe casing (1) when closed, being of sufficient length for engaging the exterior face (2) of a hollow pipe casing a sufficient area to transfer the force of the drive weight (25) of a bi-directional pipe driving ram (15) to the hollow pipe casing (1) without damage thereto, having an internal diameter (31) slightly larger than the external diameter of the hollow pipe casing (1) to be driven, so that the hollow pipe casing (1) may be slid easily through the collet (3) when the opening (24) along the length of the collet (3) is open, the internal face (4) of the collet (3) being parallel to the external face (2) of the hollow pipe casing (1), while the external face (5) of the collet (3) tapers from a thin edge (26), at the end closest to the drive weight (25), to a thick edge (27) at the opposite end, being of sufficient thickness to close the opening (24) along the length of the collet (3) when the internal face (8) of the bowls (9) which tappers outward is pressed over the tapered external face (5) of the collet (9), prior to the stop face (7) of the bowls (9) reaching the top of the stop face (6) of the collet (3). Thus, when the bowls (9) is pressed over the collet (3) to securely engage the external face (2) of the hollow pipe casing (1), the extension (11) of the base (13) of the frame (16) of the bi-directional pipe driving ram (15), by the force of gravity, rests upon the hip (42) of the bowls (9), so that the strike face (10) of the bowls (9) extends above the extension (11) of the base (13). As the bowls (9) is not attached to the frame (16), it is provided with a shoulder (43) which protrudes outwardly from its top end a sufficient distance to engage a retaining ring (44) fastened to the extension (11) of the base

(13) by standard bolt means (12), which, when secured within the threaded channels (47) in the extension (11), is fully below the inside surface (46) of the base (13), while not protruding so far as to make contact with the bolts (12) when the frame (13) is withdrawn. To facilitate separation of the bowls (9) from the collet (3) after they have been pressed together and securely engaged the external face (2) of the hollow pipe casing (1), the stop face of the collet (6) contains threaded channels (47) through its depth, regularly spaced around it, to accommodate jack bolts (45) which, when installed, can push the stop face of the bowls (7) away from the stop face of the collet (6), thus releasing the bowls (9) from the collet (3) and the collet (3) from the external face (2) of the hollow pipe casing (1).

Referring to FIG. 3, the bowls (9) is comprised of suitable hardened metal having a cylindrical interior (29), having a minimum internal diameter (35) slightly larger than the external diameter of the hollow pipe casing (1) to be driven, with one end having a flattened upper strike face (10), which extends beyond the retaining ring (44) on the extension (11) of the base (13) of the frame (16) of the bi-directional pipe driving ram (15) throughout its circumference and the retaining ring (44) being removably secured to the extension by bolt means (12) at at least two locations.

Referring to FIG. 1, said flattened upper strike face (10) receives the impact of the strike face (14) of the drive weight (25) of the bi-directional pipe driving ram (15), which strike face (14) extends beyond the bottom end (28) of the drive weight (25) so as to prevent the drive weight (25) from touching the base (13) of the frame (16) at the extent of the drive weight's (25) travel and damaging the guide rod (17) or collars (18) at either end and on both opposite sides (33) of the drive weight (25) which maintain the alignment of the drive weight (25) along the guide rods (17), which run from the top (36) of the frame (16) to the base (13) of the frame (16) of the bi-directional pipe driving ram, on at least opposite sides of the drive weight (25). The bowls (9) is of sufficient length so that the half of it opposite to the end having the flattened upper strike face (10) is sufficient to override the entire tapered external face (5) of the collet (3), with the internal face (30) of the half of the bowls adjacent to the upper strike face (10) being parallel to the external face (2) of the hollow pipe casing and the internal half (8) opposite thereto tapering outward away from the parallel line of the external face (2) of the hollow pipe casing (1) at an identical rate to the taper of the external face (5) of the collet (3), so that the bowls (9), as it is pressed over the collet (3), reduces the internal diameter (31) of the collet (3) until it securely grips the external face (2) of the hollow pipe casing (1) allowing efficient transfer of the force from the bi-directional pipe driving ram (15) to the hollow pipe casing (1).

Referring to FIG. 1, the external face (2) of the hollow pipe casing (1) is released from the grip of the internal face (4) of the collet (3) merely by withdrawing the bowls (9) from engagement with the collet (3), with or without the aid of jack bolts (45), allowing the bi-directional pipe driving ram (15) to be easily repositioned along a length of hollow pipe casing (1) or to another section of hollow pipe casing (1) fastened to the end of the one previously engaged, without removing the bi-directional pipe driving ram (15) from its position relative to the hollow pipe casing (1) sections being drilled. Should the bi-directional pipe driving ram (15) be used to remove hollow pipe casing (1) previously driven into the ground, the direction of force being applied to the hollow pipe casing (1) can be easily reversed by installing a collet (23) and bowls (22) on the hollow pipe casing (1), reversing the order and orientation, at the opposite end of the bi-directional pipe driving ram (15) and reversing the drive direction of the drive weight (25), so that the strike face (20) of the opposite end of the drive weight impacts the strike face (21) of the bowls (9) on that end of the bi-directional pipe driving ram (15).

Figure 4:
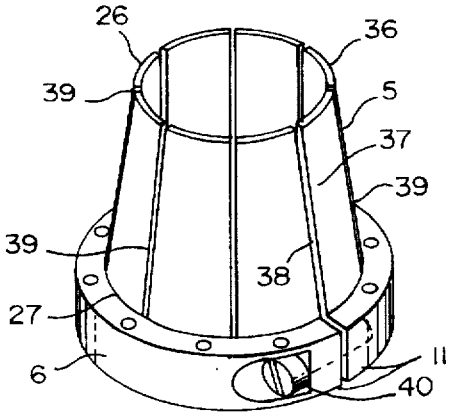
FIG. 4 is an elevational view of an alternative collet.

An alternative and preferred construction of a collet (36) is shown in FIG. 4. This preferred embodiment is comprised of a collet (36), machined so that the external face of the collet (5) is tapered to flare from the thin edge of the collet (26) to the thick edge of the collet (27) at the angle of 7.5 degrees, being split through, from the thin edge (26) to the thick edge (27), into two facing halves (37), (38), having vertical slots (39) in the tapered sides, cut from the thin edge of the external face of the collet (27) to just short of the stop face of the collet (6), said slots (39) being regularly spaced every 45 degrees around the circumference of the two facing halves of the collet (37), (38), said halves being removably attached to each other by bolt means (40) located in pre-drilled and threaded bolt holes (41) within the stop face of the collet (6). This alternative and preferred construction yields a collet (36) whose internal face parallel to the pipe casing (4) is at least 8 inches high, from the thin edge of the collet (26) to the stop face of the collet (6), and said stop face is an additional 2.5 inches in height. The bowls (9) to mate with this alternative and preferred embodiment of the collet (36) has its internal face of half of the bowls adjacent to the strike face (30) likewise tapered at a 7.5 degree angle and can be made in two facing halves and joined by bolt means in like manner to the alternative and preferred embodiment of the collet (36).

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A bi-directional pipe driving apparatus comprised of a bi-directional pipe driving ram means, having a drive weight with a top, bottom and four sides, capable of reversing drive direction, powered by suitable means, a frame with a top and a base and sides, the drive weight having collars, extruding from two opposite sides at both the top and the bottom of the drive weight, to engage guide rods extending from the top to the base of the frame within the sides thereof, said drive weight having a strike face at its top and bottom which extends beyond and perpendicular to the collars, and a cylindrical channel completely through the center of the bi-directional pipe driving ram, including through the drive weight, from top to base, of sufficient diameter to accommodate a hollow pipe casing to be driven, and a means to transfer the drive force of the bi-directional pipe driving ram to the hollow pipe casing, said means being comprised of a bowls of suitably hardened metal, having a strike face, to receive a blow of the weight of the bi-directional pipe driving ram, which extends above a shoulder which extends beyond the inside diameter of a retaining ring removably attached by bolt means, at at least two points, to an extension of the base of the frame of the bi-directional pipe driving ram, which extension is sufficiently thinner than the base so that the bolt means, when secured within threaded channels in the extension, is fully below the inside surface of the base, a cylindrical interior, of sufficient diameter to slidably accommodate a hollow pipe casing, with the interior face of the half of the cylindrical interior adjacent to the strike face being parallel to the external face of the hollow pipe casing, and having a hip protruding from its external face a sufficient distance to restrain the base of the frame of the bi-directional pipe driving ram from dropping by gravity below the shoulder, so that the base of the frame is free to move between the shoulder and the hip of the bowls and, when in operation, returns by the force of gravity to rest on the hip of the bowls after each blow of the drive weight, and the interior face of the other half of the bowls tapering outward away from the parallel line of the external face of the hollow pipe casing at an identical rate to a taper of an external face of a collet means, so that the bowls, as it is pressed over the collet reduces the internal diameter of the collet until it securely grips the external face of the hollow pipe casing, allows transfer of the force from the bi-directional pipe driving ram to the hollow pipe casing, and the collet means being comprised of a circular piece of suitable hardened metal material, having a cylindrical interior and an opening along its length of sufficient width, to slidably accommodate a hollow pipe casing within its cylindrical interior when open and to firmly grasp the external face of the hollow pipe casing when the opening is closed, and being of sufficient length, so that the cylindrical interior engages the pipe casing over a sufficient area to transfer the force of the bi-directional pipe driving ram to the hollow pipe casing without damage to the hollow pipe casing, the collet means having an internal face parallel to the external face of the hollow pipe casing and an external face which tapers from a thin edge at one end to a thick edge at the opposite end, being of sufficient thickness to close the opening in the length of the collet when the half of the interior face of the bowls tapering outward is pressed over the external face of the collet, from the thin edge of the external face of the collet to the thick edge of the external face of the collet.

2. The bi-directional pipe driving apparatus of claim 1 wherein a bowls and collet are installed on the hollow pipe casing, in reverse sequence and opposite orientation so as to enable the hollow pipe casing to be driven in the opposite direction for removal of hollow pipe casing from the earth.

3. The collet means of claim 1 machined so that the external face of the collet is tapered to flare from the thin edge of the collet to the thick edge of the collet at an angle of 7.5 degrees and being split through, from the thin edge of the collet to the thick edge of the collet, into two facing halves, having vertical slots cut from the thin edge of the external face of the collet to just short of the stop face of the collet, said slots being located every 45 degrees around the circumference of the collet, said facing halves being removably attached to each other by bolt means, located in pre-drilled and threaded bolt holes within the stop face of the collet, and being at least 8 inches from the thin edge of the collet to the stop face of the collet and the stop face of the collet being another 2.5 inches in length.

4. The collet means of claim 1 having threaded channels through its stop face regularly spaced, at at least two points, on its stop face circumference to accommodate jack bolts which, when threaded into the channels press against the stop face of the bowls, thus releasing the bowls from the collet and the collet from the external face of the hollow pipe casing.

* * * * *